US011492856B2

(12) United States Patent
Valen et al.

(10) Patent No.: US 11,492,856 B2
(45) Date of Patent: Nov. 8, 2022

(54) INVENTORY SYSTEM

(71) Applicant: Canrig Robotic Technologies AS, Sandnes (NO)

(72) Inventors: Roald Valen, Kleppe (NO); Stian Lode, Kvernaland (NO); Markus Buchholz, Stavanger (NO)

(73) Assignee: Canrig Robotic Technologies AS, Sandnes (NO)

( * ) Notice: Subject to any disclaimer, the term of this patent is extended or adjusted under 35 U.S.C. 154(b) by 0 days.

(21) Appl. No.: 16/950,800

(22) Filed: Nov. 17, 2020

(65) Prior Publication Data

US 2021/0164303 A1 Jun. 3, 2021

Related U.S. Application Data

(60) Provisional application No. 62/942,032, filed on Nov. 29, 2019.

(51) Int. Cl.
*E21B 19/14* (2006.01)

(52) U.S. Cl.
CPC ..... *E21B 19/14* (2013.01)

(58) Field of Classification Search
CPC ..... E21B 19/14; E21B 19/155; E21B 47/007; E21B 44/00
See application file for complete search history.

(56) References Cited

U.S. PATENT DOCUMENTS 8,815,310 B2 12/2014 Flusche
9,322,950 B2 4/2016 Gustavsson et al.
9,706,185 B2 * 7/2017 Ellis ..... E21B 41/00
10,196,897 B2 2/2019 Mailly et al.
10,402,662 B2 9/2019 Kozicz et al.
10,450,038 B2 10/2019 Vandenworm
10,808,465 B2 * 10/2020 Mikalsen ..... E21B 19/15
2008/0201388 A1 8/2008 Wood et al.
2009/0121895 A1 5/2009 Denny et al.
(Continued)

FOREIGN PATENT DOCUMENTS

GB 2556111 A 5/2018
NO 343029 B1 10/2018
(Continued)

OTHER PUBLICATIONS

International Search Report from PCT/EP2020/082561 dated Feb. 1, 2021, 1 pg.

*Primary Examiner* — Lynn E Schwenning
(74) *Attorney, Agent, or Firm* — Abel Schillinger, LLP

(57) ABSTRACT

A method and system for conducting a subterranean operation that can include storing, via a rig controller, pre-determined characteristics of a piece of equipment, for supporting the subterranean operation, in a unique data record associated with the piece of equipment; scanning, via one or more sensors, the piece of equipment on a rig; determining, via the rig controller, actual characteristics of the piece of equipment in response to the scanning via the one or more sensors; comparing, via the rig controller, the actual characteristics to the pre-determined characteristics; and verifying whether or not the piece of equipment is an expected piece of equipment needed to support the subterranean operation based on the comparing.

20 Claims, 10 Drawing Sheets

(56) References Cited

U.S. PATENT DOCUMENTS

| | | | | |
|---|---|---|---|---|
| 2016/0130889 | A1* | 5/2016 | Torrione | G01B 11/022 348/135 |
| 2017/0044854 | A1* | 2/2017 | Hebebrand | E21B 19/165 |
| 2017/0314369 | A1* | 11/2017 | Rosano | E21B 41/00 |
| 2018/0080306 | A1 | 3/2018 | Passolt | |
| 2019/0100988 | A1 | 4/2019 | Ellis et al. | |
| 2019/0136650 | A1* | 5/2019 | Zheng | E21B 19/166 |
| 2019/0136669 | A1 | 5/2019 | Wiedecke et al. | |

FOREIGN PATENT DOCUMENTS

| | | | |
|---|---|---|---|
| WO | 2012/165951 | A2 | 12/2012 |
| WO | 2016/160696 | A1 | 10/2016 |
| WO | 2019/018153 | A1 | 1/2019 |
| WO | 2019/173840 | A1 | 9/2019 |
| WO | 2019/174691 | A1 | 9/2019 |

* cited by examiner

INVENTORY SYSTEM

CROSS-REFERENCE TO RELATED APPLICATION(S)

This application claims priority under 35 U.S.C. § 119(e) to U.S. patent application Ser. No. 62/942,032, entitled "INVENTORY SYSTEM," by Roald VALEN et al., filed Nov. 29, 2019, which application is assigned to the current assignee hereof and incorporated herein by reference in its entirety.

TECHNICAL FIELD

The present invention relates, in general, to the field of drilling and processing of wells. More particularly, present embodiments relate to a system and method for detecting objects on a rig and comparing object characteristics to pre-determined values during subterranean operations, tracking the objects during the subterranean operations, and logging usage data for the objects during the subterranean operations.

BACKGROUND

Robots can reduce safety risks to personnel in various subterranean operations by operating in hazardous conditions and/or in dangerous locations, such as handling tubulars to make-up or break-up tubular strings. Tubular (or pipe) handling robots, such as Iron Roughnecks, automated catwalks, tubular elevators, and pipe handlers, can operate on and/or near a rig floor. For example, robotic systems can manage (or assist in management of) tubular (or other equipment) as they are manipulated on the rig (e.g., between storage areas and a wellbore). However, with increased use of robots on rigs, a decrease in the amount of human supervision and feedback can occur. Therefore, improvements in robotic systems are continually needed.

SUMMARY

In accordance with an aspect of the disclosure, a method is included for conducting a subterranean operation that can include operations of storing, via a rig controller, pre-determined characteristics of a piece of equipment, for supporting the subterranean operation, in a unique data record associated with the piece of equipment; scanning, via one or more sensors, the piece of equipment on a rig; determining, via the rig controller, actual characteristics of the piece of equipment in response to the scanning via the one or more sensors; comparing, via the rig controller, the actual characteristics to the pre-determined characteristics; and verifying whether or not the piece of equipment is an expected piece of equipment needed to support the subterranean operation based on the comparing.

In accordance with another aspect of the disclosure, a system for conducting a subterranean operation that can include a rig; rig equipment that manipulates a piece of equipment on the rig; and one or more sensors configured to scan the piece of equipment; a rig controller configured to: store pre-determined characteristics of the piece of equipment in a unique data record associated with the piece of equipment; receive sensor data from the one or more sensors; determine actual characteristics of the piece of equipment based on the sensor data; compare the actual characteristics to the pre-determined characteristics; and verify whether or not the piece of equipment is an expected piece of equipment needed to support the subterranean operation based on the comparison.

BRIEF DESCRIPTION OF THE DRAWINGS

These and other features, aspects, and advantages of present embodiments will become better understood when the following detailed description is read with reference to the accompanying drawings in which like characters represent like parts throughout the drawings, wherein.

DETAILED DESCRIPTION

Present embodiments provide a robotic system for detecting objects (or pieces of equipment) on a rig and comparing object characteristics to pre-determined values during subterranean operations, tracking the objects during the subterranean operations, and logging usage data for the objects during the subterranean operations. The aspects of various embodiments are described in more detail below.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

The use of the word "about", "approximately", or "substantially" is intended to mean that a value of a parameter is close to a stated value or position. However, minor differences may prevent the values or positions from being exactly as stated. Thus, differences of up to ten percent (10%) for the value are reasonable differences from the ideal goal of exactly as described. A significant difference can be when the difference is greater than ten percent (10%).

Figure 1:
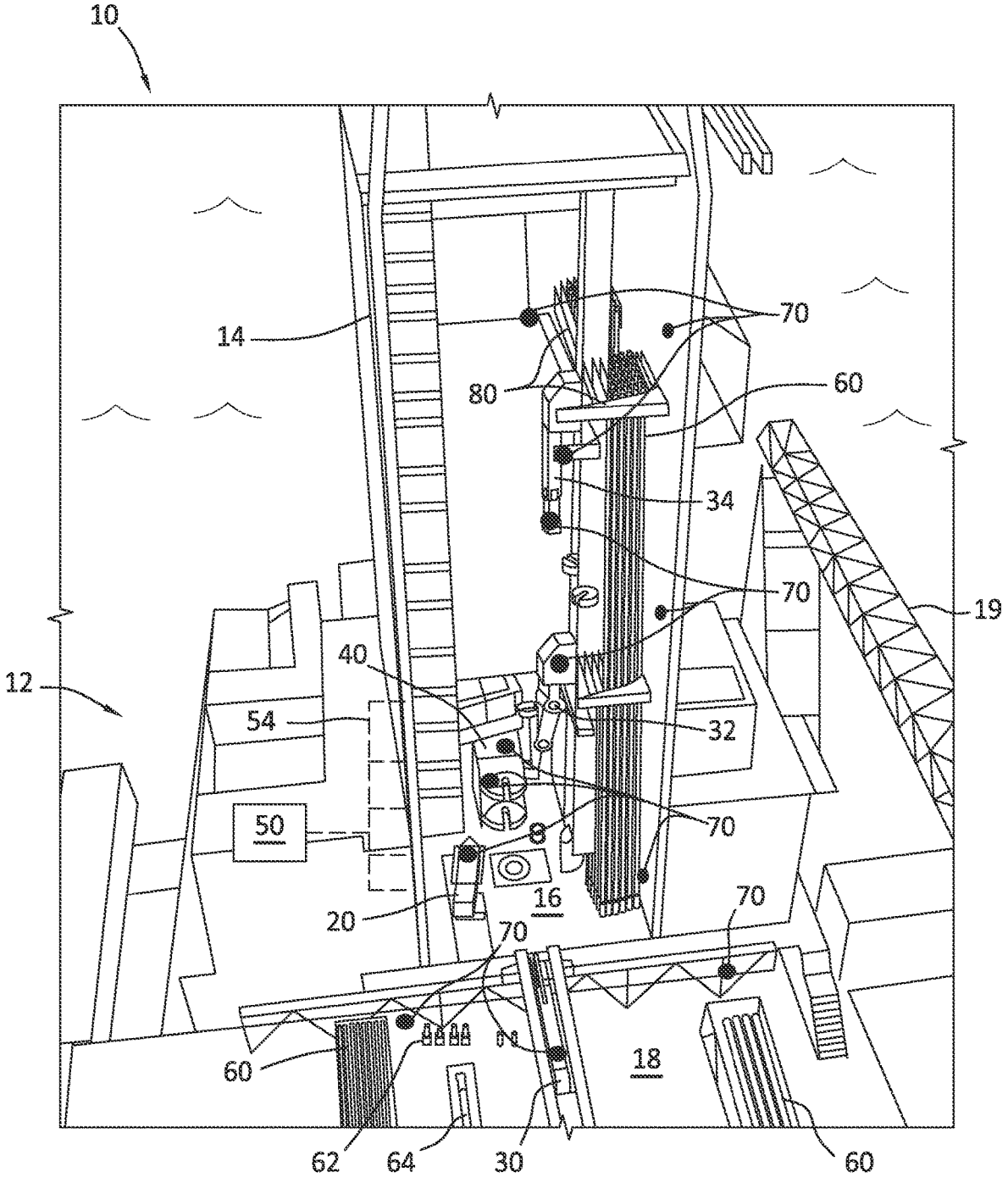
FIG. 1 is a representative view of a rig used to perform subterranean operations, in accordance with certain embodiments.

FIG. 1 is a representative view of a rig 10 that can be used to perform subterranean operations. The rig 10 is shown as an offshore rig, but it should be understood that the principles of this disclosure are equally applicable to onshore rigs as well. The example rig 10 can include a platform 12 with a derrick 14 extending above the platform 12 from the rig floor 16. The platform 12 and derrick 14 provide the general super structure of the rig 10 from which the rig equipment is supported. The rig 10 can include a horizontal storage area 18, pipe handlers 30, 32, 34, a drill floor robot 20, an iron roughneck 40, a crane 19, fingerboards 80, and a plurality of sensors 70 distributed at various locations on the rig 10. The sensors 70 can be any type of sensors that can detect various characteristics of the equipment being used on the rig 10.

The sensors 70 can be 2D cameras, 3D cameras, infrared cameras, CCTV cameras, X-ray sensors, strain gauges, torque sensors, accelerometers, optical sensors, laser sensors, physical contact sensors, contact sensors with encoders, audio sensors, pressure sensors, temperature sensors, environmental sensors, gas sensors, liquid sensors, or other suitable sensors for detecting characteristics of the rig environment and equipment. The sensors 70, as well as other equipment on the rig 10, can be communicatively coupled to a rig controller 50 via a network 54, with the network 54 being wired or wirelessly connected to the sensors 70 or equipment.

The sensors 70 can be disposed on stationary locations (such as on or above the horizontal storage area 18, at various points along the fingerboard storage 80, on the derrick, on the platform, etc.). The sensors 70 can also be disposed on the robotic equipment, such as the drill floor robot 20, the iron roughneck 40, the pipe handlers 30, 32, 34, a top drive (not shown), and the crane 19. Some of the equipment that can be used during subterranean operations is shown in the horizontal storage area 18 and the fingerboards 80, such as the tubulars 60, the tools 62, and the bottom hole assembly (BHA) 64. The tubulars 60 can include drilling tubular segments, casing tubular segments, and tubular stands that are made up of multiple tubular segments. The tools 62 can include centralizers, subs, slips, subs with sensors, adapters, etc. The BHA 64 can include drill collars, instrumentation, and a drill bit.

Figure 2:
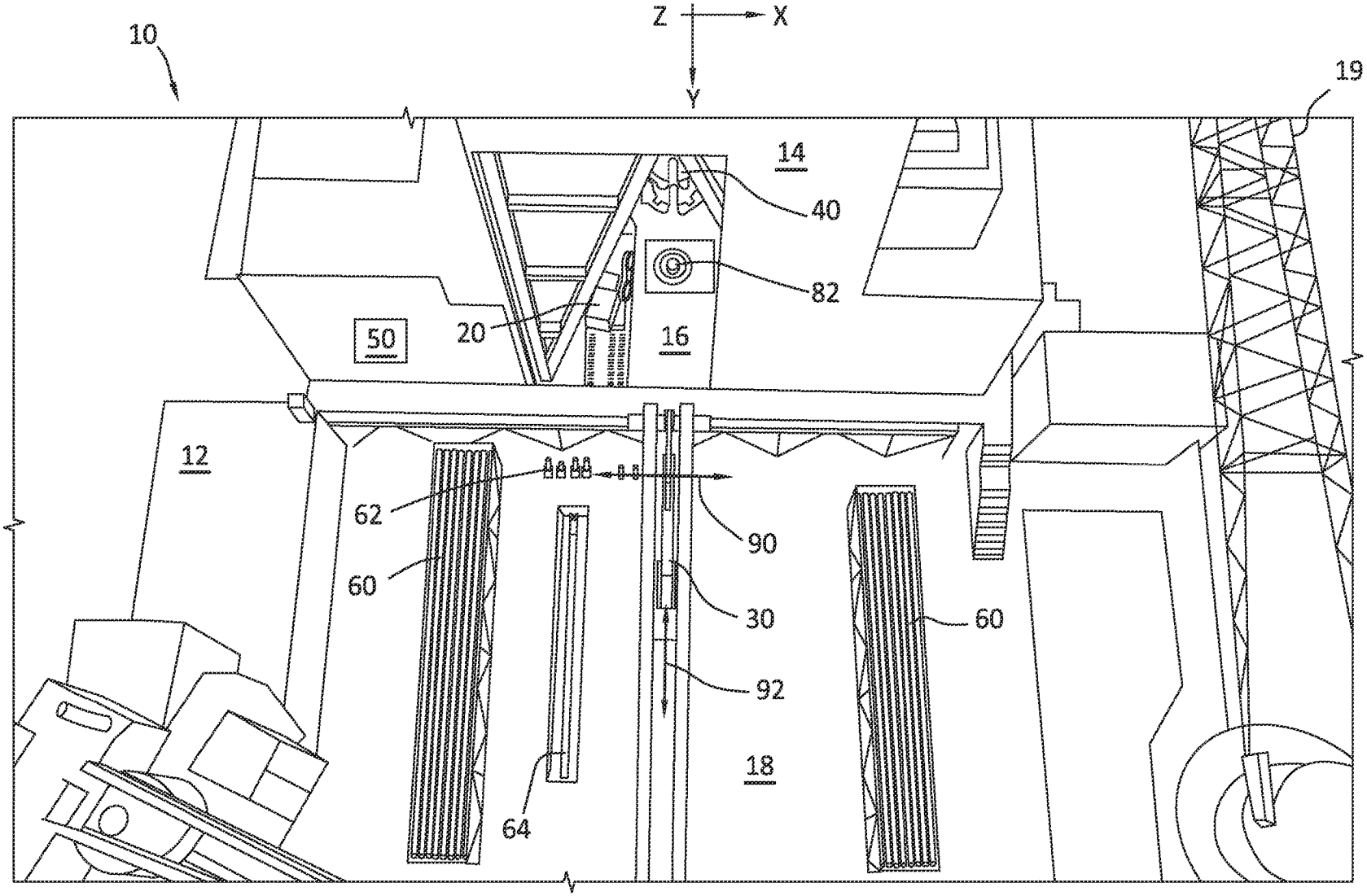
FIG. 2 is a representative perspective view of pipe handler that operates over a horizontal storage area on a rig used to perform subterranean operations, in accordance with certain embodiments.

FIG. 2 is a representative perspective view of pipe handler 30 that operates over a horizontal storage area 18 on a rig 10 used to perform subterranean operations (e.g., drilling, treating, completing, producing, killing, etc.). The pipe handler 30 can move along rails in an X-direction (arrows 90) and move along a bridge across the rails in a Y-direction (arrows 92). This allows the pipe handler 30 to access the full horizontal storage area 18. The pipe handler 30 can scan the objects stored in the horizontal storage area 18 by scanning the objects with one or more sensors 70 and communicating the sensor data to the rig controller 50. It should be understood that the rig controller 50 can include one or more processors, non-transitory memory storage that can store data and executable instructions, where the one or more processors are configured to execute the executable instructions, a graphical user interface (GUI), one or more input devices, one or more displays, and a communication link to a remote location. The rig controller 50 can also include processors disposed in the robots for local control of the robots or distributed about the rig 10. Each processor can include non-transitory memory storage that can store data and executable instructions.

Figure 3:
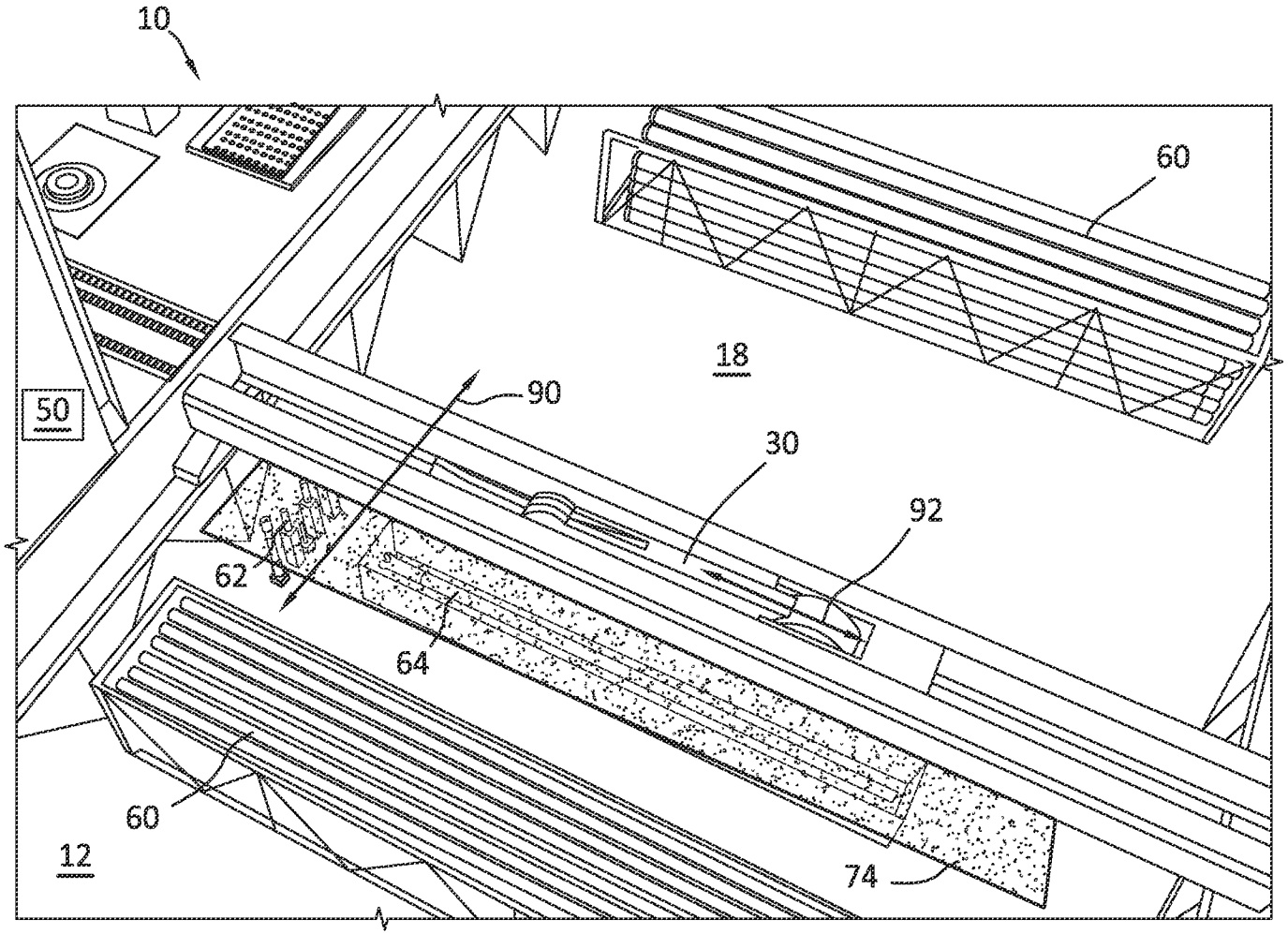
FIG. 3 is another representative perspective view of pipe handler that operates over a horizontal storage area on a rig used to perform subterranean operations, in accordance with certain embodiments.

FIG. 3 is another representative perspective view of pipe handler 30 that operates over a horizontal storage area 18 on a rig 10 used to perform subterranean operations. Before (or after) contacting the equipment in the horizontal storage area 18, the pipe handler 30 can scan the equipment (representatively illustrated by a scan zone 74 under the pipe handler 30) with one or more sensors 70 (e.g., one or more cameras, one or more scanners, etc.) and identify characteristics of the equipment, such as dimension (e.g., lengths, diameters, spacings, etc.), linearity of the equipment, visible features on the equipment (bar codes, Q-codes, other machine readable patterns, gradient patterns, color patterns, etc.), and a type of the equipment (e.g., tubulars (including drill pipes and casings), tubulars stands, tools, BHA, drill floor equipment, etc.).

The rig controller 50 can create a unique data record for each piece of equipment, which can include equipment 60, 62, 64, the drill floor robot 20, the iron roughneck 40, the pipe handlers 30, 32, 34, a top drive, a tubular running tool, the crane 19, catwalks (not shown), transport vehicles (e.g., trucks, ships, etc.). The information contained in the unique data record can be created from data received for each piece of equipment from a manufacturer, an operator, a remote controller, lab tests, data books, sensors, or combinations thereof. The rig controller 50 can use the data to check characteristics of the equipment when the equipment is moved about the rig 10. The unique data record can also be created when the handling equipment first senses data related to the equipment, such as via scans, visual input, physical contact, etc. with the equipment. The rig controller 50 can give each data record a unique record ID that is associated with a respective piece of equipment. The unique record ID can be used by the rig controller 50 to associate additional data about the respective piece of equipment and store the additional data (e.g., historical data including usage data, degradation data, expected end of life data, life cycle data, etc.) in the unique data record that is associated with the unique record ID. Therefore, the complete record of a particular piece of equipment (or at least a portion of the unique data record) can be retrieved by providing the unique record ID to the rig controller 50 via the GUI, another input device, or another controller and requesting a report of the data associated with the unique record ID. Known database techniques can be used to build and manage the unique data records, so these database techniques will not be discussed in more detail.

The data record for each piece of equipment can include (but is not limited to) characteristics of the equipment such as 1) equipment contact zones that include positions to grip the equipment, 2) equipment non-contact zones that are positions to not grip equipment, 3) center of gravity, 4) diameters along the equipment, 5) shape of the equipment, 6) weight of the equipment, 7) dimensions of the equipment, 8) type of the equipment (e.g., tool, BHA, drill floor equipment, etc.), 9) usage log of the equipment, 10) degradation parameters of the equipment (e.g., wear locations, damaged locations, etc.), 11) manufacturing details of the equipment (e.g., materials, life cycles, tolerances, specifications, etc.), 12) longitudinal linearity of the equipment, 13) historical data of the piece of equipment, or 14) combinations thereof. Some characteristics considered to be historical data can also be seen as pre-determined characteristics, since even previously acquired historical data collected during subterranean operations can be used to compare to more recently collected characteristics during subterranean operations to detect trends or detect changes from one collection time to another. Other pre-determined characteristics can be received from sources other than scanning the equipment via one or more sensors, such as manufacturer's data.

Figure 4:
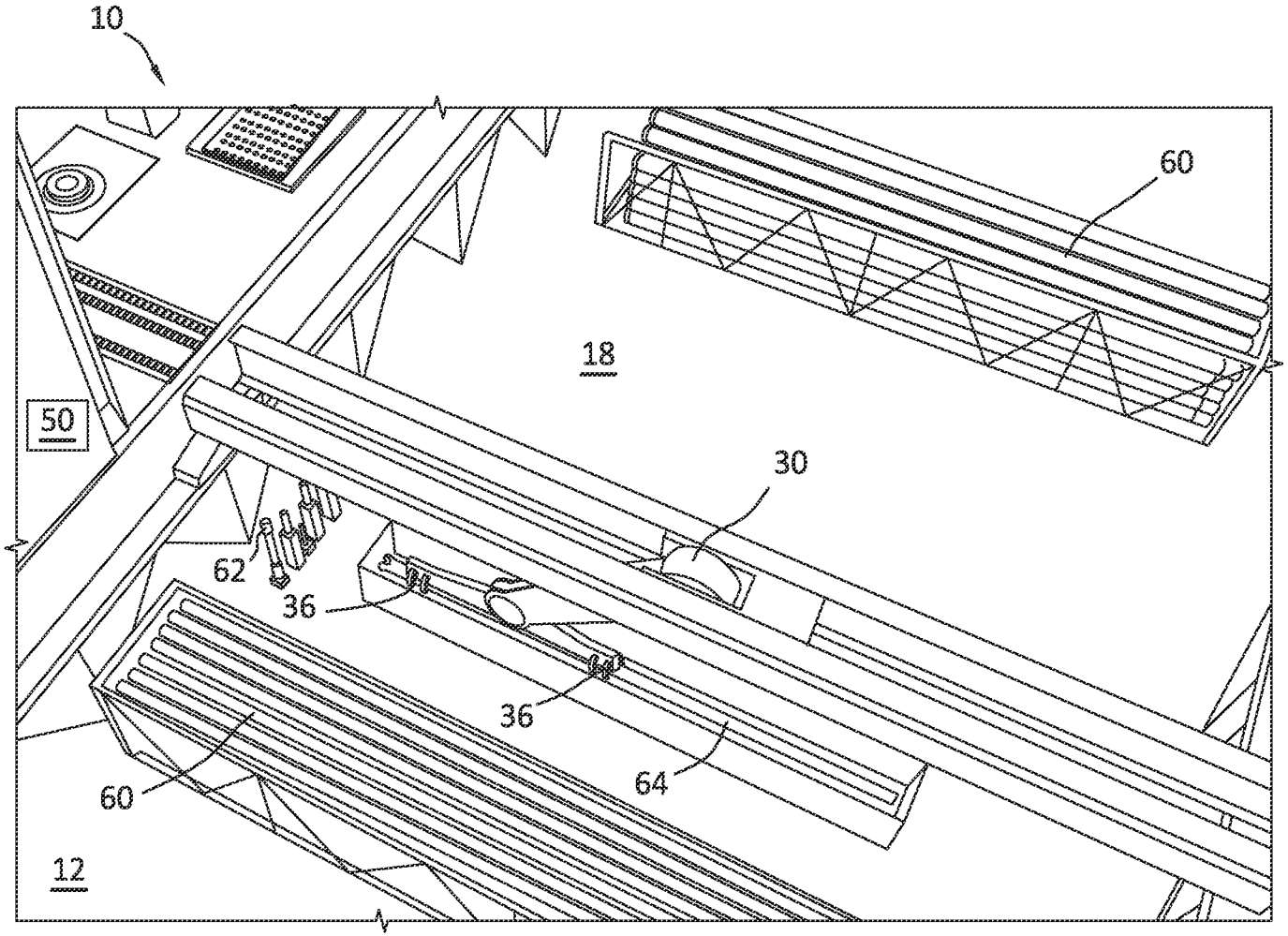
FIG. 4 is another representative perspective view of pipe handler that engages a piece of equipment (e.g., a BHA) contained in a horizontal storage area on a rig used to perform subterranean operations, in accordance with certain embodiments.

FIG. 4 is another representative perspective view of the pipe handler 30 that engages a piece of equipment (e.g., a BHA 64) contained in a horizontal storage area 18 on a rig 10 used to perform subterranean operations. Once the sensors 70 on the pipe handler 30 (or other sensors 70) have detected at least some of the characteristics of a particular piece of equipment in the, the pipe handler 30 can engage the particular piece of equipment (e.g., a BHA 64 in this example) with grippers 36.

The pipe handler 30 can include sensors 70 (e.g., strain gauges, weight sensors, pressure sensors, imaging sensors, etc.) on the grippers 36 or elsewhere that can collect sensor data that can be used by the rig controller 50 to determine actual characteristics of the piece of equipment (e.g., diameters, dimensions, shapes, weight, center of gravity, etc.) and the rig controller 50 can compare the detected characteristics with pre-determined (or pre-defined) characteristics and verify if the detected characteristics are an acceptable match to the pre-determined (or pre-defined) characteristics or if they are not acceptable. The pre-determined (or pre-defined) characteristics can be provided by a manufacturer, an operator, a remote controller, lab tests, data books, sensors, or combinations thereof and communicated to the rig controller 50 so the rig controller 50 can build the unique data record for the particular piece of equipment. The rig controller 50 can update the data record with the detected characteristics if the detected characteristics are acceptable matches with the pre-determined (or pre-defined) characteristics. Also, in cases where the characteristics have not yet been entered into the rig controller 50 for the particular piece of equipment, the rig controller 50 can save the detected characteristics in the data record for future verifications.

Figure 5:
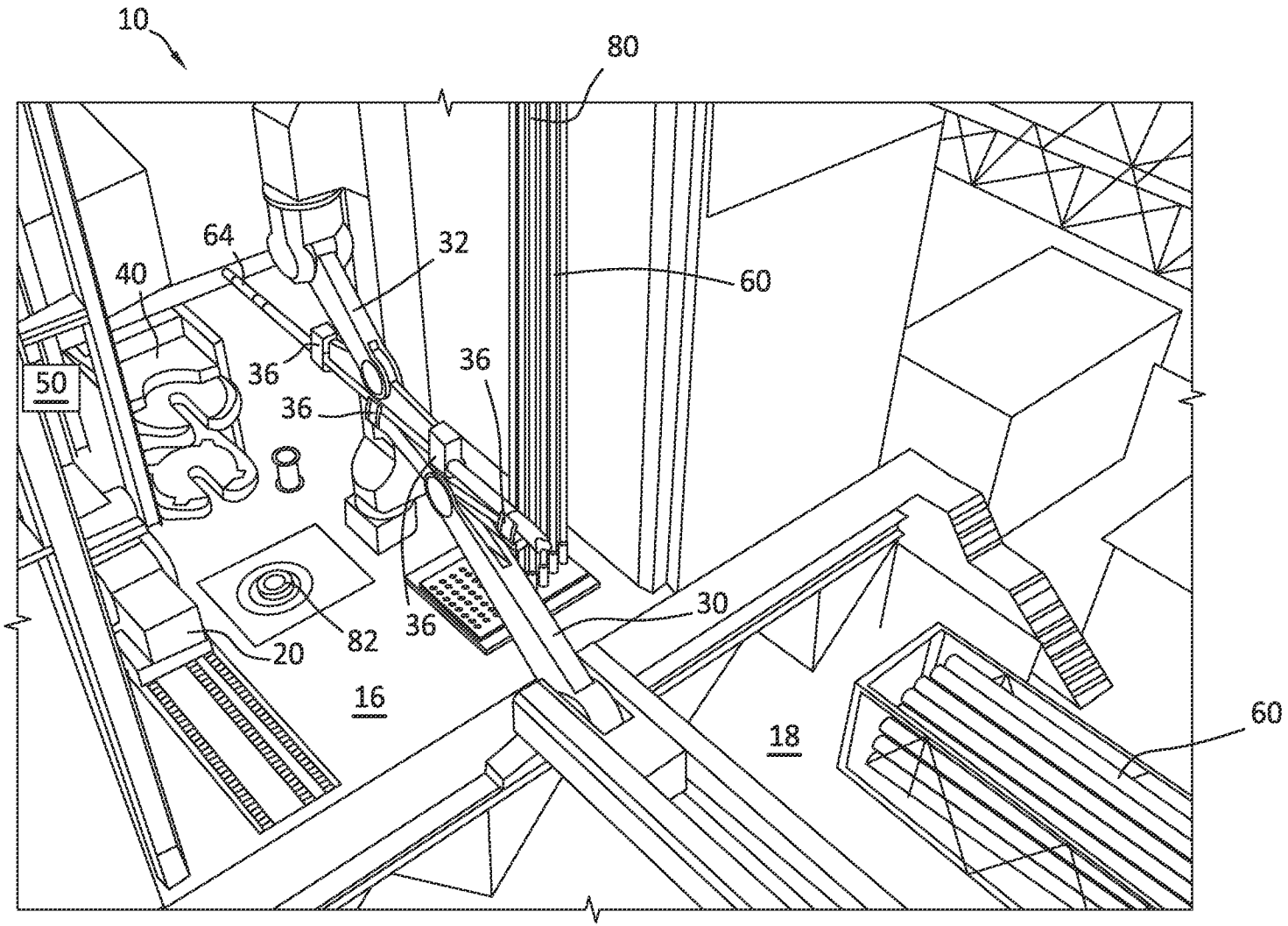
FIG. 5 is a representative perspective view of pipe handler, that operates over a horizontal storage area, transferring equipment to a pipe handler on a rig floor of a rig used to perform subterranean operations, in accordance with certain embodiments.

FIG. 5 is a representative perspective view of the pipe handler 30 transferring a piece of equipment (e.g., a BHA 64) to a pipe handler 32 on a rig floor 16. During transporting the equipment from the horizontal storage area 18 to a pipe handler 32, the pipe handler 30 can provide further verification of a center of gravity of the equipment, the weight of the equipment, dimensions of the equipment (e.g., diameters, lengths, shapes), etc. Sensors 70 on the pipe handlers 30, 32 can be used to guide the pipe handler 30 to hand off the equipment to the pipe handler 32 as well as determine characteristics of the equipment (e.g., a BHA 64, a tubular 60, a tool 62, etc.). Other sensors 70 not disposed on or in the pipe handlers 30, 32 can also be used to assist in coordinating the transfer of the equipment from the pipe handler 30 to the pipe handler 32 as well as determine characteristics of the equipment. The sensors 70 on the pipe handler 32 can support redundant checks of equipment characteristics (e.g., diameters, weight, center of gravity, etc.) by detecting sensor data and communicating the sensor data to the rig controller 50. The rig controller 50 can determine the detected characteristics based on the sensor data and possibly other known characteristics (e.g., dimensions) to verify the detected characteristics against the pre-determined (or pre-defined) characteristics stored in the unique data record to this particular piece of equipment.

For example, torque sensors 70 of the pipe handler 30 (or pipe handler 32) can provide torque sensor data to the rig controller 50, which can determine an estimated center of gravity of the equipment by the variations in force required by the grippers and the pipe handler to move and rotate the equipment. These variations can be used, along with the known weight and dimensions of the equipment, by the rig controller 50 (which can include local controllers on each pipe handler 32, 34, 36) to determine the estimated center of gravity for the piece of equipment and the rig controller 50 can store this newly acquired information in the unique data record for the equipment. Furthermore, weight of the equipment can be measured and verified by the pipe handlers 30, 32, 34 by sensors 70 (e.g., strain sensors) coupled to the pipe handler 30, 32, 34 to detect the weight being carried by the grippers 36. The weight may also be determined from known dimensions of the equipment and from torque sensors 70 that monitor motor torque in the pipe handler 30, 32, 34. The measured torque and known dimensions of the equipment can be used by the rig controller 50 to calculate a weight of an object being held by the pipe handler 30, 32, 34. Once these characteristics are determined, they can be compared to pre-determined characteristic values (e.g., from a manufacturer) stored in the unique data record for the equipment to verify that the actual equipment being moved by the pipe handler is the expected equipment needed for the subterranean operation.

In some operations, the pipe handler 30 can retrieve a tubular 60 from the horizontal storage area 18, detect characteristics of the tubular 60 via the sensors 70 on pipe handler 30 (or the rig 10) and the rig controller 50, verify that the actual equipment (e.g., the tubular 60) held by the pipe handler 30 is the expected equipment needed for a subterranean operation. If the detected characteristics are within acceptable value ranges when compared to the pre-determined characteristics, then rig controller 50 can continue the subterranean operation. If the detected characteristics are not within acceptable value ranges when compared to the pre-determined characteristics, then an error message can be sent by the rig controller 50 to an operator via the GUI or to a controller at a local or remote location to initiate corrective action.

As used herein, "characteristics" refer to characteristics of equipment used on a rig 10 during subterranean operations, such as historical data, dimensions, shapes, non-contact zones, contact zones, equipment type, diameters, ID markers, defects, degradation parameters, and manufacturing details of the equipment (e.g., materials, properties of the material, life cycles, tolerances, specifications, etc.). As used herein, "detected characteristics" refers to those characteristics of the equipment that can be determined by the rig controller 50 based on sensor data received from the sensors 70. As used herein, "pre-determined characteristics" refer to those characteristics of the equipment that are stored in the unique data record. Some of the "pre-determined characteristics" can be used to verify future characteristic values determined from sensor data from the sensors 70. As used herein, "historical data" refers to data that is collected, calculated, observed, or estimated before or after the equipment arrives on the rig 10. Therefore, the "historical data' can also include the "predetermined" (or "pre-defined") data. The "historical data" can include usage data (e.g., where used, when used, how used, etc.), storage location data, life cycle data, expected end of life data, degradation data, unique identifiers, visible features detected, linearity data, calculated characteristics (e.g., center of gravity, weight), torque measurements (e.g., motor torque, pipe joint torque), revolutions required to thread or unthread a joint, etc.

Figure 6:
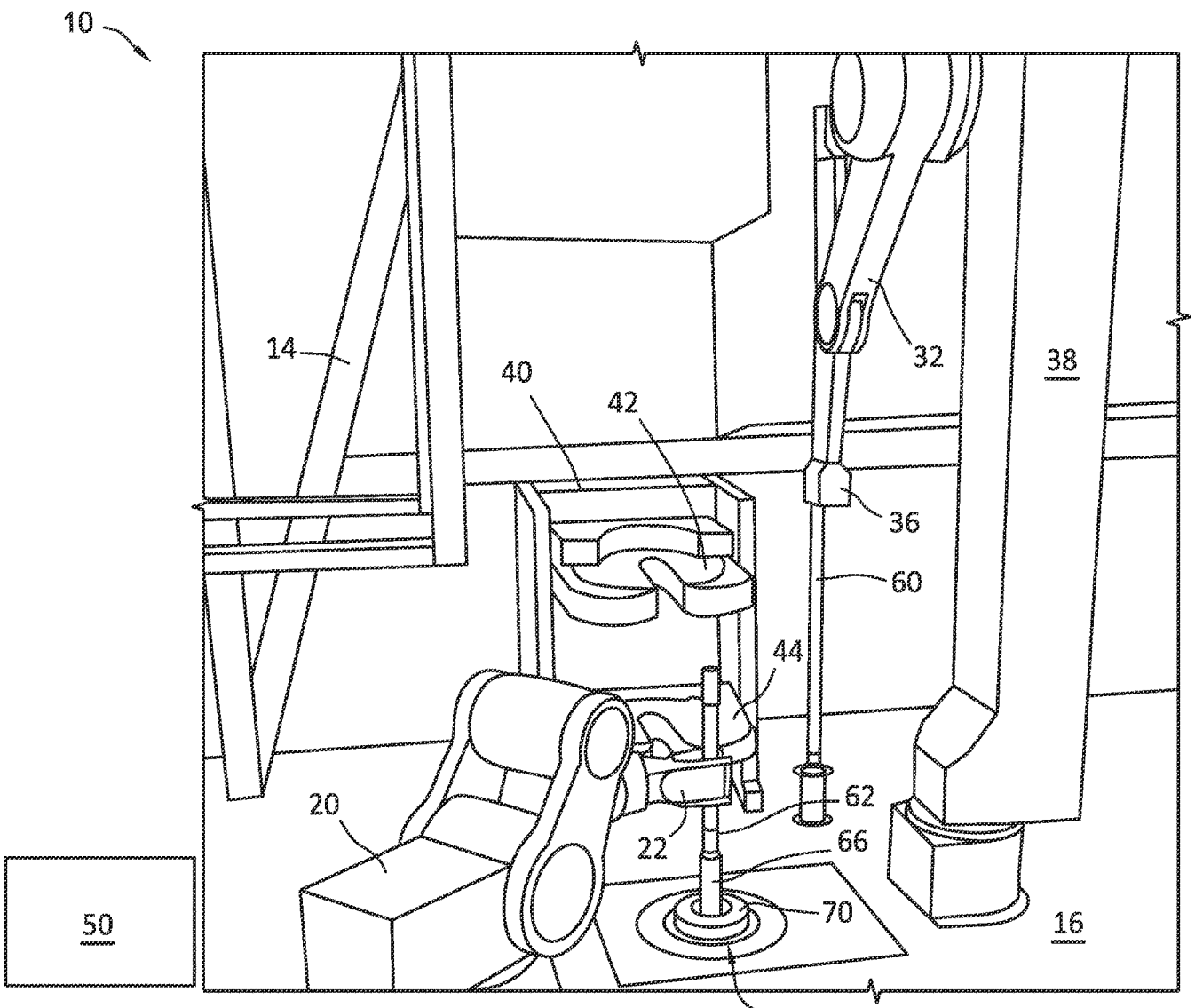
FIG. 6 is a representative perspective view of robots used on a drill floor of a rig during subterranean operations, in accordance with certain embodiments.

FIG. 6 is representative perspective view of some exemplary robots that can be used on a drill floor 16 of a rig 10 during subterranean operations. FIG. 6 shows a drill floor robot 20 gripping a tool 62 at the top end of the tubular string 66. The gripper 22 can engage the tool 62 and spin it off the top of the tubular string 66 in preparation for installing a tubular 60 to the end of the tubular string 66. The pipe handler 32 can engage a tubular 60 with the grippers 36 and move the tubular 60 from a storage location or the pipe handler 30 to a well center 82 where the pipe handler 32 can thread the tubular 60 onto the tubular string 66. The iron roughneck 40 can torque the joint via torque wrenches 42, 44. Sensors 70 can be positioned on or around the robots to provide sensor data that can be used to coordinate movements of the robots, as well as collect sensor data for determining equipment characteristics.

Figure 7:
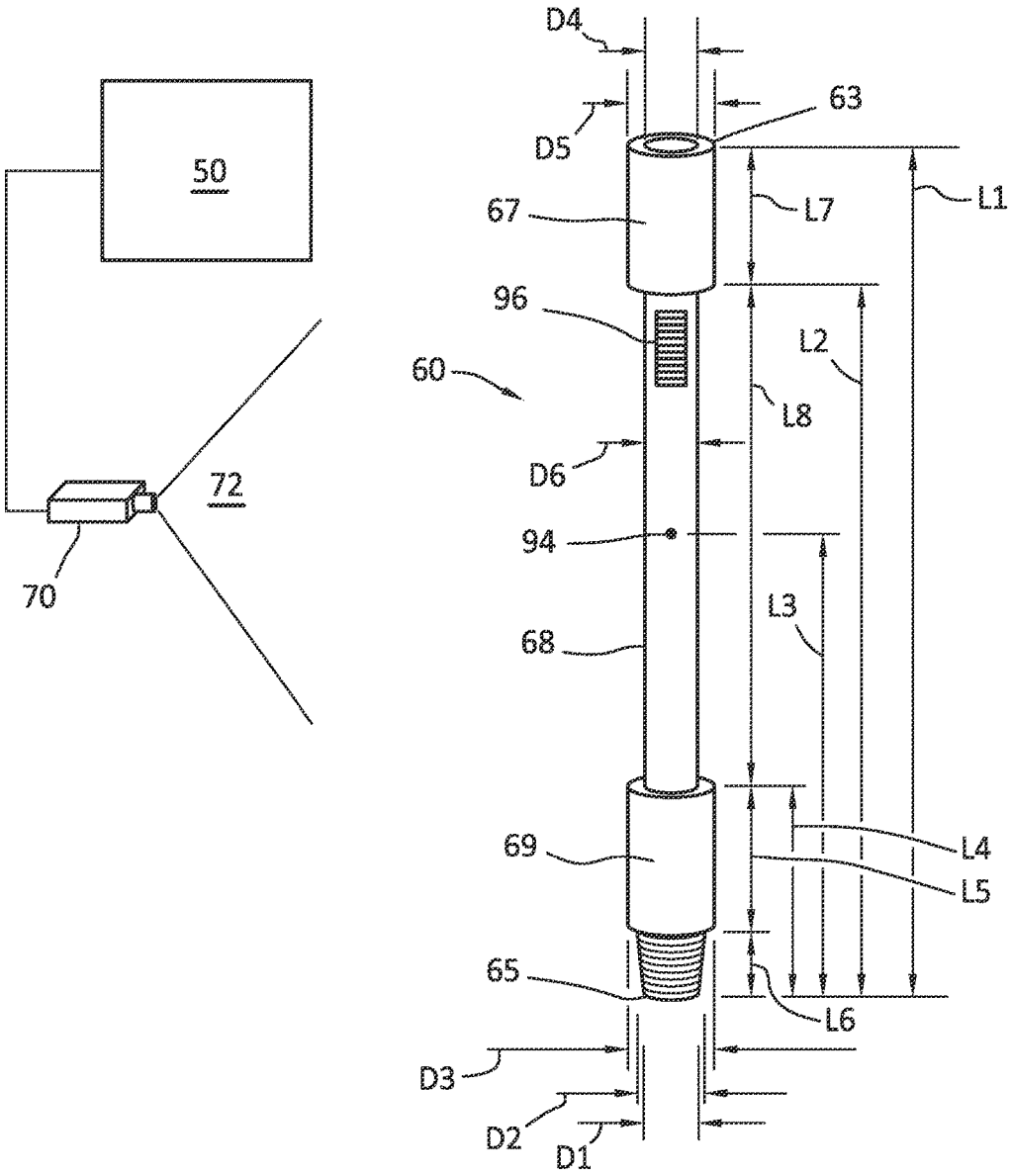
FIGS. 7-9 are representative functional diagrams of a imaging system used to detect characteristics of equipment (e.g., drill tubulars, drill stands, tools, etc.) used in subterranean operations, in accordance with certain embodiments.

FIG. 7 is a representative functional diagram of a imaging system used to detect characteristics of equipment (e.g., drill tubulars 60) used in subterranean operations. In this example, the sensor 70 can be an imaging device 70 with a field of view 72. It should be understood that multiple imaging devices 70 can be used to detect the equipment characteristics. The rig controller 50 can calibrate the field of view 72 of each imaging device 70 by capturing images with objects of known size and calibrating the images based on the known object. Therefore, when unknown objects are captured in images from the imaging device 70, the dimensions of the unknown object can be determined. The rig controller 50 can also calibrate each imaging device 70 by comparing captured images to a 3D model of the rig and determining a location of the imaging device on the rig and perspective view of the location. With the captured images calibrated to the 3D model, then the sizes of objects that correlate to objects in the 3D model are known and the imaging device can then capture images of an unknown object or piece of equipment and the rig controller 50 can determine the dimensions of unknown objects.

For continued discussion, the exemplary imaging sensor 70 in FIG. 7 has been calibrated and can capture images that the rig controller 50 can use to determine dimensions of a piece of equipment in its field of view 72. The piece of equipment can be stationary in the field of view for enough time for the imaging device to capture the necessary images, or the piece of equipment can move through the field of view while the imaging device captures the necessary images.

For a tubular 60, some of the characteristics that can be determined by the rig controller 50 based on captured images from the sensor 70 are shown in FIG. 7. The tubular 60 can include a box end 67 and a pin end 69, with a body section 68 in between the ends 67, 69. The pin end 69 can include a threaded portion with external threads. The threads can be formed on a portion that is tapered from an outer diameter D2 to an outer diameter D1. D4 can be the inner diameter of the pin end 69, the box end 67, and the body 68. The box end can include an outer diameter D5. The body 68 portion of the tubular 60 can have an outer diameter D6. The diameter D6 can be substantially constant along the body portion 68. However, if the diameter D6 is not substantially equal along the body portion 68, the rig controller 50 can determine the variations in the diameters along the body 68 or the pre-determined characteristics data can provide the various diameters.

The location of the center of gravity 94 can be estimated by the outer and inner dimensions of the tubular 60 via the rig controller 50 and captured images. With the inner and outer diameters D1-D6 determined and the other outer dimensions determined, L1, L2, L4-L8, the rig controller 50 can estimate the volume of material in the tubular 60 and determine an estimated location of the center of gravity 94 based on the dimensions and the estimated volume. This calculation can assume that the inner diameter D4 through the tubular 60 is substantially constant and that the material of the tubular 60 is the same in the determined volume. The length L3 can then be determined, which is the distance from the end 65 of the pin end 69 and the estimated location of the center of gravity 94. However, as described above, the center of gravity 94 can also be determined from captured sensor data from sensors 70 that provide torque data and strain data from the pipe handlers 30, 32, 34 as the pipe handlers manipulate the tubular 60.

The length L1 refers to an overall length of the tubular 60 from the end 65 to the end 63 of the tubular 60. The length L2 refers to the length from the end 65 to the bottom edge of the box end 67. The length L3 refers to the length from the end 65 to the center of gravity 94. The length L4 refers to the length from the end 65 to the top edge of the pin end 69. The length L5 refers to the length between the top edge of the pin end 69 collar and the bottom edge of the pin end 69 collar. The length L6 refers to the length from the end 65 of the pin end 69 to the top of the threaded section of the pin end 69. The length L7 refers to the length from the end 63 of the box end 67 to the bottom edge of the box end 67. The length L8 refers to the length of the body section 68 between the top edge of the pin end 69 and the bottom edge of the box end 67. Bottom and top are relative terms to indicate opposite directions. In this example, the box end 67 is at the top of the tubular 60 and the pin end 69 is at the bottom of the tubular 60. Even if the tubular 60 is rotated into other orientations than shown in the figures, the box end 67 can always be referred to as the top of the tubular 60 with the pin end 69 referred to as the bottom. Therefore, for this discussion, bottom refers to items that are closer to the pin end 69 and top refers to items that are closer to the box end 67.

The diameters D1, D2, D3, D4, D5, D6 can be determined by the rig controller 50 based on captured images. With the imaging sensor 70 calibrated as described above, captured images that contain the features of the tubular 60 can be communicated to the rig controller 50 and processed to determine the respective dimensions (i.e., diameters D1-D6 and L1-L8) of the features. It should be understood that shapes and dimensions of equipment other than the tubular 60 can be determined through capturing images and having the rig controller 50 process the images to determine the dimensions and shapes, and detect other visible features of the equipment.

The visible feature 96 can be bar codes, Q-codes, other machine-readable patterns, gradient patterns, color patterns, physical patterns, protrusions, recesses, or combinations thereof. The visible feature 96 can have characteristic data associated with the equipment that is embedded in the visible feature 96 or the visible feature 96 can provide a unique code that can be used by the rig controller 50 to reference characteristic data associated with the equipment. The received characteristic data can be entered into a data record for the equipment for later retrieval, analysis, or updating.

Figure 8:
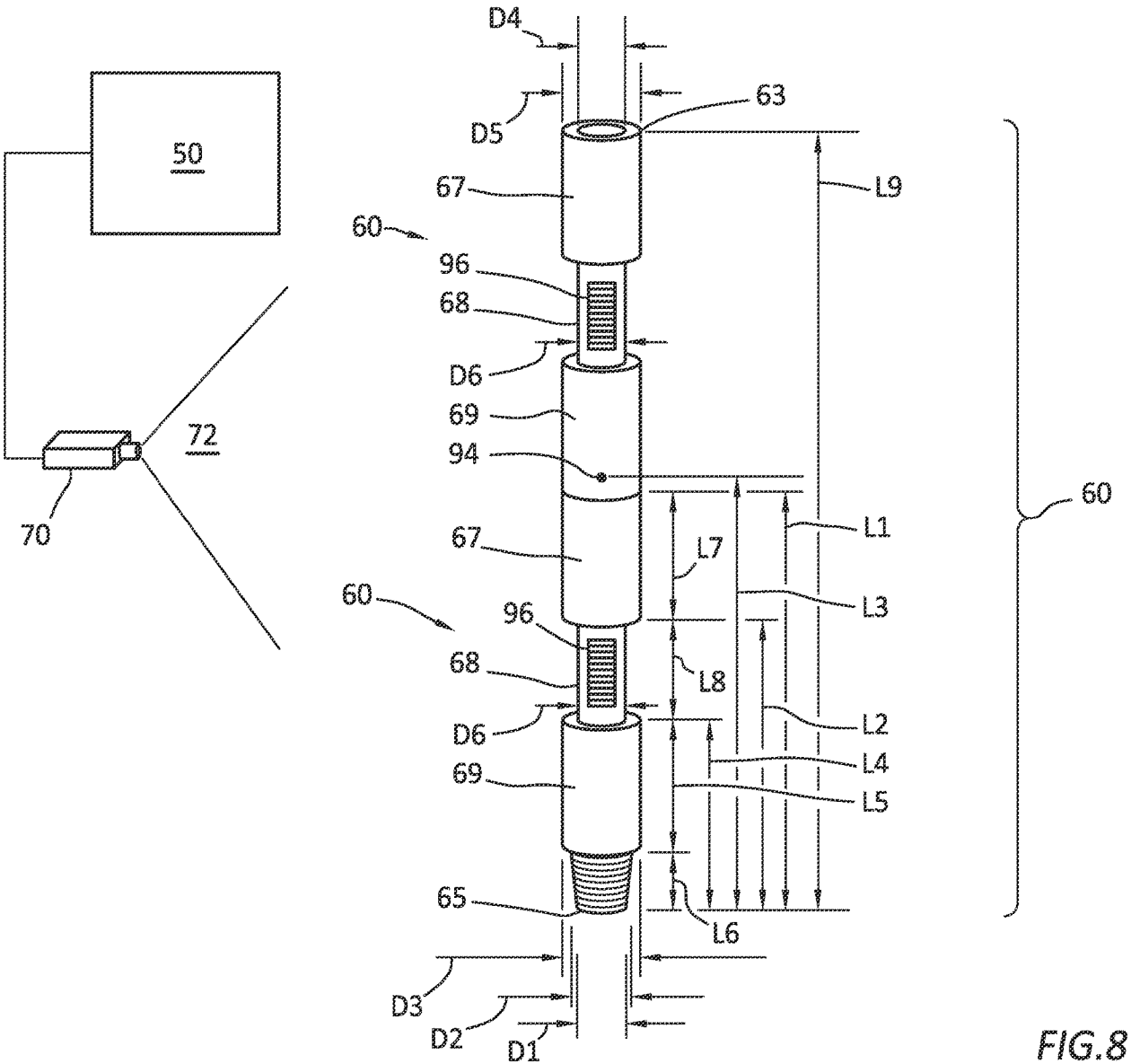

FIG. 8 is a representative functional diagram of a imaging system used to detect characteristics of equipment (e.g., tubular stand 60) used in subterranean operations. In this example, the sensor 70 can be an imaging device 70 with a field of view 72. It should be understood that multiple imaging devices 70 can be used to detect the equipment characteristics. The rig controller 50 can calibrate the field of view 72 of each imaging device 70 by capturing images with objects of known size and calibrating the images based on the known object. Therefore, when unknown objects are captured in images from the imaging device 70, the dimensions of the unknown object can be determined. The rig controller can also calibrate each imaging device 70 by comparing captured images to a 3D model of the rig and determining a location of the imaging device on the rig and perspective view of the location. With the captured images calibrated to the 3D model, then the sizes of objects that correlate to objects in the 3D model are known and the imaging device can then capture images of an unknown object or piece of equipment and the rig controller 50 can determine the dimensions of unknown object.

For continued discussion, the imaging sensor 70 in FIG. 8 has been calibrated and can capture images that the rig controller 50 can use to determine dimensions of a piece of equipment in its field of view 72. The piece of equipment can be stationary in the field of view for enough time for the imaging device to capture the necessary images, or the piece of equipment can move through the field of view while the imaging device captures the necessary images.

For a tubular stand 60, some of the characteristics that can be determined by the rig controller 50 based on captured images from the sensor 70 are shown in FIG. 8. The discussion above related to the diameters D1-D6 of the tubular 60 are directly applicable to each individual tubular 60 that is included in the tubular stand 60.

The location of the center of gravity 94 of the tubular stand 60 can be estimated by the outer and inner dimensions of the tubular 60 via the rig controller 50 and captured images. With the inner and outer diameters D1-D6 determined for each tubular 60 and the other outer dimensions determined (e.g., L1, L2, L4-L9), the rig controller 50 can estimate the volume of material in the tubular 60 and determine an estimated location (i.e., L3) of the center of gravity 94 based on the dimensions and the estimated volume. This calculation can assume that the inner diameter through the tubular stand 60 is substantially constant and that the material of the tubulars 60 is the same in the determined volume. The length L3 can then be determined, which is the distance from the end 65 of the pin end 69 of the lower tubular 60 and the estimated location of the center of gravity 94. It should also be understood that the tubular 60 can include various materials with various characteristics and the center of gravity can still be estimated by calculating the volume of the various materials, determining their relative positioning in the tubular 60, determining a center of gravity for each volume of varying materials, and then determining, via the rig controller 50, the center of gravity 94 for the entire object (e.g., tubular, tubular stand, casing, BHA, etc.). However, as described above, the center of gravity 94 can also be determined from captured sensor data from sensors 70 that provide torque data and strain data from the pipe handlers 30, 32, 34 as the pipe handlers manipulate the tubular stand 60.

The length L1 refers to an overall length of the lower tubular 60 from the end 65 of the lower tubular 60 to the top edge of the lower tubular 60. The length L2 refers to the length from the end 65 of the lower tubular 60 to the bottom edge of the box end 67 of the lower tubular 60. The length L3 refers to the length from the end 65 of the lower tubular 60 to the center of gravity 94 of the tubular stand 60. The length L4 refers to the length from the end 65 of the lower tubular 60 to the top edge of the pin end 69 of the lower tubular 60. The length L5 refers to the length between the top edge of the pin end 69 of the lower tubular 60 and the bottom edge of the pin end 69 of the lower tubular 60. The length L6 refers to the length from the end 65 of the pin end 69 of the lower tubular 60 to the top of the threaded section of the pin end 69 of the lower tubular 60.

The length L7 refers to the length from the end 63 of the box end 67 of the lower tubular 60 to the bottom edge of the box end 67 of the lower tubular 60. The length L8 refers to the length of the body section 68 between the top edge of the pin end 69 of the lower tubular 60 and the bottom edge of the box end 67 of the lower tubular 60. The length L9 refers to the length of the tubular stand 60 from the bottom end 65 of the lower tubular 60 to the top end 63 of the upper tubular 60. Bottom and top are relative terms to indicate opposite directions. In this example, the box end 67 is at the top of each tubular 60 and the pin end 69 is at the bottom of each tubular 60. Even if the tubular stand 60 is rotated into other orientations than shown in the figures, the box end 67 can always be referred to as the top of the tubular 60 with the pin end 69 referred to as the bottom. Therefore, for this discussion, bottom of the tubular stand 60 refers to items that are closer to the pin end 69 of the lower tubular 60 and top refers to items that are closer to the box end 67 of the upper tubular 60.

It should be understood that the upper tubular 60 can have similar lengths L1-L8 as described for the lower tubular 60, with the discussion related to the lengths L1-L8 being directly applicable to the lengths L1-L8 of each tubular 60. The length L9 equals L1 in a tubular stand 60 with only one tubular 60. With tubular stands 60 of two tubulars 60, the length L9 can be approximately equal to (L1×2)−L6. With tubular stands 60 of three tubulars 60, the length L9 can be approximately equal to (L1×3)−(L6×2).

The diameters D1, D2, D3, D4, D5, D6 can be determined by the rig controller 50 based on captured images. With the imaging sensor 70 calibrated as described above, captured images that contain the features of the tubular stand 60 can be communicated to the rig controller 50 and processed to determine the respective dimensions (i.e., diameters D1-D6 and L1-L9) of the features. It should be understood that shapes and dimensions of equipment other than the tubular stand 60 can be determined through capturing images and having the rig controller 50 process the images to determine the dimensions and shapes, and detect other visible features of the equipment.

Each visible feature 96 can be bar codes, Q-codes, other machine-readable patterns, gradient patterns, color patterns, physical patterns, protrusions, recesses, or combinations thereof. Each visible feature 96 can have characteristic data associated with the equipment that is embedded in the visible feature 96 or the visible feature 96 can provide a unique code that can be used by the rig controller 50 to reference characteristic data associated with the equipment. The received characteristic data can be entered into a data record for the equipment for later retrieval, analysis, and updating.

Figure 9:
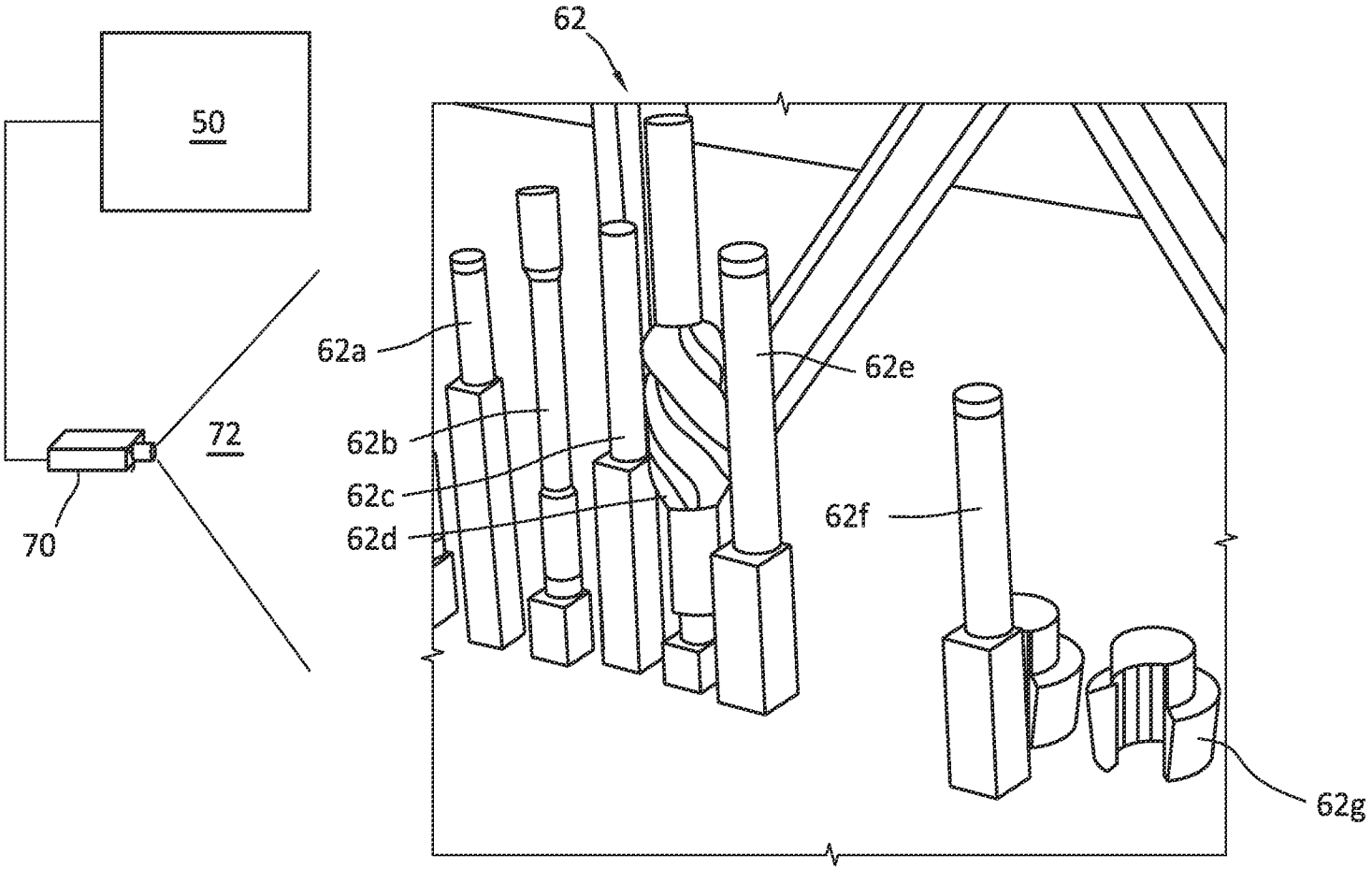

FIG. 9 is representative functional diagram of a imaging system used to detect characteristics of equipment (e.g., tools) used in subterranean operations. The illustrated tools 62 can include tools (62*a*-62*g*) used by the drill floor robot 20 during subterranean operations. For example, the tool

62*b* can be used to attach to a top of a BHA 64 assembly to support manipulations by the pipe handlers 30, 32, 34 of the BHA 64 when it is delivered to well center 82 or removed from well center 82. The tool 62*g* can be slips that are available to replace slips at well center 82. Tool 62*d* can be a centralizer for a tubular string 66. Various other tools 62 can be used by the rig equipment to support subterranean operations. With robotic systems used on the rig 10, it is necessary to provide tool recognition capabilities, which can use the same system elements are described above for recognizing the diameters, dimensions, shapes, of the tubulars 60.

When these tools are first delivered to the rig 10 (e.g., to the horizontal storage area 18) a data record can be created by the rig controller 50 to capture any supplied manufacturers data about the specific tool 62. When the pipe handler 30 scans or picks up the specific tool, it can provide sensor data about the specific tool 62 to the rig controller 50 that can compare the sensor data to the pre-determined characteristics of the tool stored in the unique data record for the specific tool 62. If the calculated characteristics substantially match with the pre-determined characteristics of the tool, the rig controller 50 can log in the data record that the tool characteristics have been verified and the tool is ready to use or store. When a tool 62 is stored in a tool storage area, such as one shown in FIG. 9, then the storage location of the specific tool is communicated to the rig controller 50 which stores it in the data record. If the tool 62 is used and returned to a same or different storage location, the rig controller 50 can keep track of the removal from storage, usage while out of storage, and the location when it is stored again. As with other equipment, the rig controller 50 continues to receive sensor data from sensors 70 around the rig, verify the sensor data with the pre-determined characteristics in the data record, update historical data in the data record, or keep track of movements of the specific tool or particular equipment including storage locations and operating locations.

It should be understood that the rig controller 50, via sensors 70 and communication with rig equipment can track movement and storage of individual pieces of equipment, including storage locations. For example, when a tubular 60 is retrieved from the horizontal storage area 18 by pipe handler 30, transferred to pipe handler 32, and stored in a fingerboard location, the sensors and pipe handlers communicate with the rig controller 50 and can help the rig controller 50 track the movements and storage locations of the tubular 60. Therefore, the rig controller 50, at any point in time can contain complete unique data records on at least the equipment (e.g., tubulars 60, tubular stands 60, a BHA 64, a tool 62, etc.) used in support of the subterranean operations. The data records can be continually accessed and updated on a real-time basis based on the communication with the sensors 70 and the rig equipment.

As the equipment is utilized or stored on the rig, the sensors 70 can observe the equipment. This observation by the sensors can be used to determine defects or damage to the equipment as it is used on the rig 10. The defects can be visible defects, such as wear locations and damaged areas, as well as calculated defects, such as when the weight of a piece of equipment falls below an acceptable value, when threads of a tubular are damaged, when drill bit is damaged, etc. When the rig controller 50 detects these defects, corrective actions can be initiated by the rig controller 50 directly, by alerting an operator or other local controller to initiate the corrective actions, or by alerting a controller at a remote location.

The observation can also detect degradation of the rig equipment as well, such as the pipe handlers 30, 32, 34, the roughneck 40, the drill floor robot 20, the fingerboards 80, and slips at well center 82 by observing the rig equipment in operation and detecting operation that is outside of acceptable parameters. For example, if the slips at well center 82 allow the tubular string 66 to slip while the slips engage the tubular string 66 can indicate failure of the slips to grip the tubular string 66. For example, if the pipe handlers 30, 32, 34 do not follow the desired path such that it deviates an unacceptable amount from the desired path. For example, when the equipment is not delivered at the desired location by the rig equipment. The rig controller 50 can receive sensor data that indicates a pending failure event of the rig equipment as well as unacceptable degradation or damage to particular equipment being manipulated the rig equipment.

The rig controller 50 (which can include local controllers at the rig equipment) can control the rig equipment to extend the rig equipment's life span by reducing high stress conditions of the robots on the rig 10. One control method to minimize damage and wear on the rig equipment can be to provide a path planning control function for robots on the rig 10 that handle the equipment, such as pipe handlers 30, 32, 34, drill floor robot 20, etc. If an object is to be moved from point A in a 3D space (such as on a rig 10) to point B in that 3D space, some path planning control functions can adjust the torque, acceleration, or speed of the motors of the robotic arms to transport the equipment directly from point A to point B.

Figure 10B:
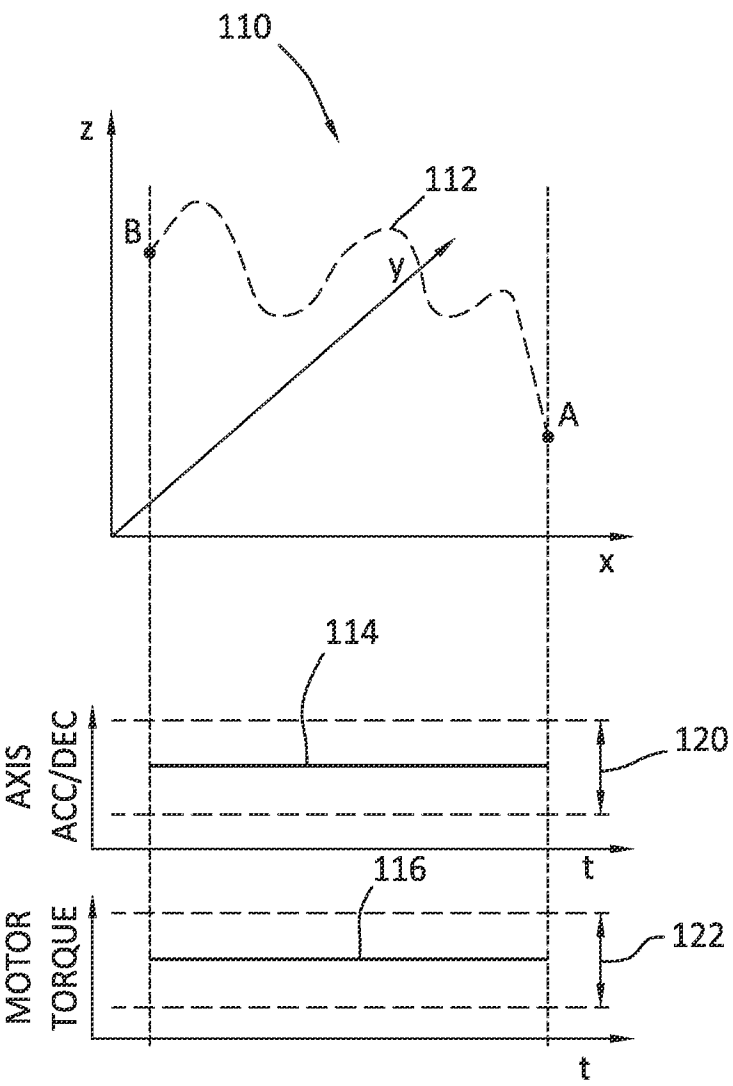
FIGS. 10A-10B are a representative plots of path planning method examples for control of robots used in subterranean operations, in accordance with certain embodiments.
Figure 10A:
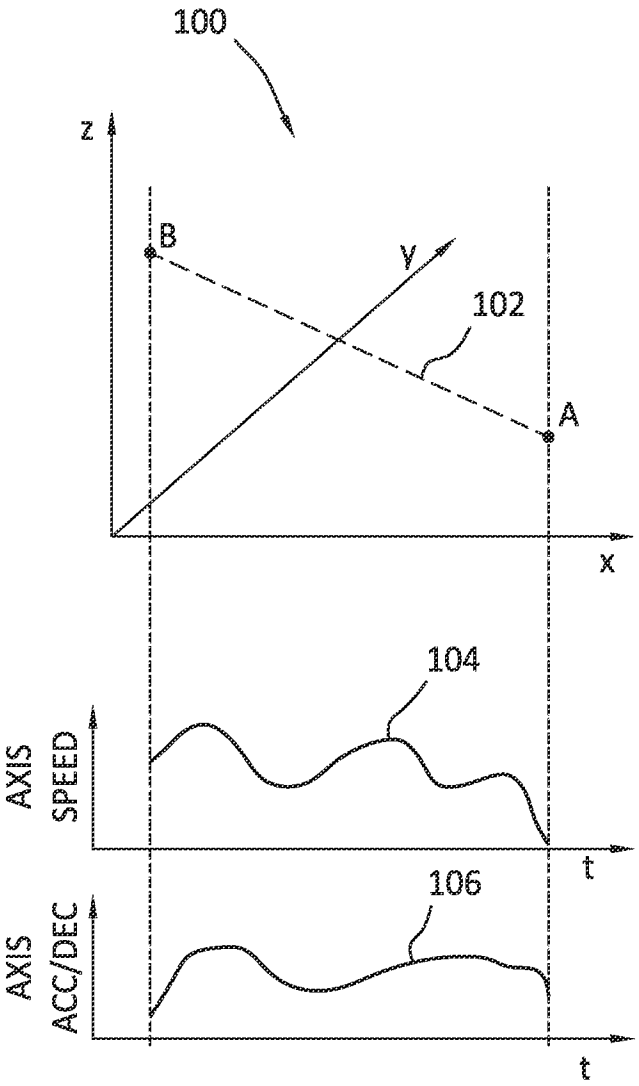

FIG. 10A generally illustrates the planning control function 100 that adjusts the torque, acceleration, or speed of the motors of the robotic arms to transport the equipment directly from point A to point B. The plotted line 102 indicates a straight line path from point A to point B. To achieve this straight line path 102, the torque, acceleration, or speed of the motors is adjusted. The plotted line 104 can indicate variations in the speed of a motor in the robotic arm, where the plotted line 106 can indicate variations in the acceleration of a motor in the robotic arm. The wide variations in acceleration and speed can increase the stress on the robotic components.

The inventors have determined that stress on the robotic components can be reduced to extend the life span of the robotic components and thus minimize down time on a rig for replacement of components or other maintenance operations.

FIG. 10B generally illustrates the planning control function 110 that adjusts a path between point A to point B to minimize variations in the torque, acceleration, or speed of the motors of the robotic arms to transport the equipment from point A to point B. The plotted line 112 can indicate a somewhat meandering path from point A to point B. The path from point A to point B can be adjusted, sometimes in real-time, to minimize variations in the torque, acceleration, or speed of the motors as the object is moved from point A to point B. The plotted line 114 can indicate minimal variations in the acceleration/deceleration of a motor in the robotic arm as a result of the adjusted path indicated by line 112, where the plotted line 116 can indicate minimal variations in the torque of a motor in the robotic arm as a result of the adjusted path indicated by line 112. The path can be adjusted to ensure that the acceleration/deceleration and torque remain within pre-determined operating ranges 120, 122 respectively. This can reduce stress on the robotic components, reduce wear on the components, and lengthen the life span of the components.

Additionally, the path can be adjusted depending upon the weight being carried by the rig equipment. As the weight of objects being carried by the rig equipment increases, the path of the object from point A to point B can be adjusted to minimize variations in torque and acceleration. For example, with higher weight loads, the robotic equipment can carry the object closer to the support structure of the robot, thereby minimizing a moment arm of force acting on the robotic equipment. With lower weight loads, the robotic equipment can carry the object further away from the support structure of the robot, while still minimizing a moment arm of force acting on the robotic equipment. Therefore, varied loads can cause path adjustments to maintain torque and acceleration within a pre-determined operating range.

Another aspect of path planning that can reduce stress on the robotic components is a path planner that does not include (or at least minimizes) stops and starts in the path, since static forces required to get an object moving from a resting position is greater than when the object is moving and is merely redirected to follow a desired path without stopping and starting. Robotic systems can design object path movement by the robots to be go here, stop, go here, stop, go here, stop, and on and on. However, by developing a path of the object that does not include stops, but causes the object to be directed along the path by changed directions without stopping to make the changes in direction. This can possibly be referred to as "smooth" direction changes where the robot controls the components to move the object from point A to point B while keeping the object in motion and using the inertia of the motion to propel the object along an altered direction. These control methods along with the minimized variations of the acceleration and torque of the components can extend the life of the components of the robots and reduce maintenance down times.

VARIOUS EMBODIMENTS

Embodiment 1

A method for conducting a subterranean operation, the method comprising:

storing, via a rig controller, pre-determined characteristics of a piece of equipment, for supporting the subterranean operation, in a unique data record associated with the piece of equipment;

scanning, via one or more sensors, the piece of equipment on a rig;

determining, via the rig controller, actual characteristics of the piece of equipment in response to the scanning via the one or more sensors;

comparing, via the rig controller, the actual characteristics to the pre-determined characteristics; and verifying whether or not the piece of equipment is an expected piece of equipment needed to support the subterranean operation based on the comparing.

Embodiment 2

The method of embodiment 1, wherein the piece of equipment is one of a tubular, a tubular stand, a tool, a bottom hole assembly (BHA), or drill floor piece of equipment.

Embodiment 3

The method of embodiment 1, wherein the unique data record comprises:

contact zones of the piece of equipment,
non-contact zones of the piece of equipment,
center of gravity of the piece of equipment,
diameters along the piece of equipment,
shapes of the piece of equipment,
weight of the piece of equipment,
dimensions of the piece of equipment,
type of the piece of equipment,
usage data of the piece of equipment,
degradation parameters of the piece of equipment,
manufacturing details of the piece of equipment,
longitudinal linearity of the piece of equipment,
historical data of the piece of equipment, or
combinations thereof.

Embodiment 4

The method of embodiment 3, wherein the type of the piece of equipment is selected from a group consisting of a tool, a tubular, a tubular stand, a BHA, and drill floor piece of equipment.

Embodiment 5

The method of embodiment 3, wherein the degradation parameters of the piece of equipment comprise a location of wear, a severity indicator of wear, a type of wear, a location of damage, a severity indicator of damage, a type of damage, hours in service, or combinations thereof.

Embodiment 6

The method of embodiment 3, wherein the manufacturing details of the piece of equipment comprise materials, life cycles, tolerances, specifications, mechanical properties of the materials, recommended operating conditions, or combinations thereof.

Embodiment 7

The method of embodiment 3, wherein the non-contact zones are specific zones or areas on the piece of equipment that should not be contacted by rig equipment when the piece of equipment is manipulated by the rig equipment.

Embodiment 8

The method of embodiment 3, wherein the contact zones are specific zones or areas on the piece of equipment that can be contacted by rig equipment when the piece of equipment is manipulated by the rig equipment.

Embodiment 9

The method of embodiment 8, wherein the rig equipment comprises pipe handlers, drill floor robot, top drive, elevator, iron roughneck, crane, fingerboard, slips, doping bucket, or combinations thereof.

Embodiment 10

The method of embodiment 3, further comprising calculating an estimated center of gravity of the piece of equipment, comparing the estimated center of gravity to the center of gravity in the unique data record, and initiating corrective action on the rig when the estimated center of gravity is not substantially equal to the center of gravity in the unique data record.

Embodiment 11

The method of embodiment 3, further comprising calculating an estimated center of gravity of the piece of equipment, the calculating comprising:

determining, via the rig controller, the dimensions of the piece of equipment of the piece of equipment including lengths and diameters;

determining a volume of material in the piece of equipment based on the dimensions;

determining a mass of the piece of equipment based on the volume of material and properties of the material; and calculating the estimated center of gravity of the piece of equipment based on the mass of the piece of equipment and the dimensions.

Embodiment 12

The method of embodiment 3, further comprising calculating an estimated center of gravity of the piece of equipment, the calculating comprising:

determining, via the rig controller, the dimensions of the piece of equipment including lengths and diameters;

manipulating the piece of equipment via rig equipment;

sensing torque and strain of the rig equipment, via sensors on the rig equipment, as the rig equipment manipulates the piece of equipment; and calculating an estimated center of gravity of the piece of equipment based on the torque and strain of the rig equipment and the dimensions.

Embodiment 13

The method of embodiment 3, wherein the usage data comprises time the piece of equipment is in operation on the rig, where the piece of equipment is used in the subterranean operation, when the piece of equipment is used in the subterranean operation, how the piece of equipment is used in the subterranean operation, or combinations thereof.

Embodiment 14

The method of embodiment 3, wherein the historical data comprises the usage data, storage location data, life cycle data, expected end of life data, degradation data, unique identifiers, visible features detected, linearity data, calculated characteristics, torque measurements, revolutions required to thread or unthread a joint, or combinations thereof.

Embodiment 15

The method of embodiment 1, wherein the one or more sensors comprise 2D camera, 3D camera, infrared camera, CCTV camera, X-ray sensor, strain gauge, torque sensor, accelerometer, optical sensor, laser sensor, physical contact sensor, contact sensor with encoder, audio sensor, pressure sensor, temperature sensor, environmental sensor, gas sensor, liquid sensor, or combinations thereof.

Embodiment 16

The method of embodiment 3, wherein the longitudinal linearity of the piece of equipment comprises measurements of deviation of the piece of equipment from being parallel to a central longitudinal axis.

Embodiment 17

The method of embodiment 1, further comprising receiving the pre-determined characteristics of the piece of equipment from a manufacturer, an operator, a remote controller, lab tests, data books, or combinations thereof.

Embodiment 18

A system for conducting a subterranean operation, the system comprising:

a rig;

rig equipment that manipulates a piece of equipment on the rig; and one or more sensors configured to scan the piece of equipment;

a rig controller configured to:

store pre-determined characteristics of the piece of equipment in a unique data record associated with the piece of equipment;

receive sensor data from the one or more sensors;

determine actual characteristics of the piece of equipment based on the sensor data;

compare the actual characteristics to the pre-determined characteristics; and verify whether or not the piece of equipment is an expected piece of equipment needed to support the subterranean operation based on the comparison.

Embodiment 19

The system of embodiment 18, wherein the unique data record comprises:

contact zones of the piece of equipment,
non-contact zones of the piece of equipment,
center of gravity of the piece of equipment,
diameters along the piece of equipment,
shapes of the piece of equipment,
weight of the piece of equipment,
dimensions of the piece of equipment,
type of the piece of equipment,
usage data of the piece of equipment,
degradation parameters of the piece of equipment,
manufacturing details of the piece of equipment,
longitudinal linearity of the piece of equipment,
historical data of the piece of equipment, or
combinations thereof.

Embodiment 20

The system of embodiment 19, wherein the type of the piece of equipment is selected from a group consisting of a tool, a tubular, a tubular stand, a BHA, and drill floor piece of equipment.

Embodiment 21

The system of embodiment 19, wherein the degradation parameters of the piece of equipment degradation parameters comprise a location of wear, a severity indicator of wear, a type of wear, a location of damage, a severity indicator of damage, a type of damage, hours in service, or combinations thereof.

Embodiment 22

The system of embodiment 19, wherein the manufacturing details of the piece of equipment comprise materials, life cycles, tolerances, specifications, mechanical properties of the materials, recommended operating conditions, or combinations thereof.

Embodiment 23

The system of embodiment 19, wherein the non-contact zones are specific zones or areas on the piece of equipment that should not be contacted by rig equipment when the piece of equipment is manipulated by the rig equipment.

Embodiment 24

The system of embodiment 19, wherein the contact zones are specific zones or areas on the piece of equipment that can be contacted by rig equipment when the piece of equipment is manipulated by the rig equipment.

Embodiment 25

The system of embodiment 24, wherein the rig equipment comprises pipe handlers, drill floor robot, top drive, elevator, iron roughneck, crane, fingerboard, slips, doping bucket, or combinations thereof.

Embodiment 26

The system of embodiment 19, wherein the rig controller is further configured to calculate an estimated center of gravity of the piece of equipment, compare the estimated center of gravity to the center of gravity in the unique data record, and initiate corrective action on the rig when the estimated center of gravity is not substantially equal to the center of gravity in the unique data record.

Embodiment 27

The system of embodiment 19, wherein the rig controller is further configured to calculate an estimated center of gravity of the piece of equipment, by:

determining, via the rig controller, the dimensions of the piece of equipment including lengths and diameters;

determining a volume of material in the piece of equipment based on the dimensions;

determining a mass of the piece of equipment based on the volume of material and properties of the material; and calculating the estimated center of gravity of the piece of equipment based on the mass of the piece of equipment and the dimensions.

Embodiment 28

The system of embodiment 19, wherein the rig controller is further configured to calculate an estimated center of gravity of the piece of equipment, by:

determining, via the rig controller, the dimensions of the piece of equipment including lengths and diameters;

manipulating the piece of equipment via rig equipment;

sensing torque and strain of the rig equipment, via sensors on the rig equipment, as the rig equipment manipulates the piece of equipment; and calculating an estimated center of gravity of the piece of equipment based on the torque and strain of the rig equipment and the dimensions.

Embodiment 29

The system of embodiment 19, wherein the usage data comprises time the piece of equipment is in operation on the rig, where the piece of equipment is used in the subterranean operation, when the piece of equipment is used in the subterranean operation, how the piece of equipment is used in the subterranean operation, or combinations thereof.

Embodiment 30

The system of embodiment 19, wherein the historical data comprises the usage data, storage location data, life cycle data, expected end of life data, degradation data, unique identifiers, visible features detected, linearity data, calculated characteristics, torque measurements, revolutions required to thread or unthread a joint, or combinations thereof.

Embodiment 31

The system of embodiment 18, wherein the one or more sensors comprise 2D camera, 3D camera, infrared camera, CCTV camera, X-ray sensor, strain gauge, torque sensor, accelerometer, optical sensor, laser sensor, physical contact sensor, contact sensor with encoder, audio sensor, pressure sensor, temperature sensor, environmental sensor, gas sensor, liquid sensor, or combinations thereof.

While the present disclosure may be susceptible to various modifications and alternative forms, specific embodiments have been shown by way of example in the drawings and tables and have been described in detail herein. However, it should be understood that the embodiments are not intended to be limited to the particular forms disclosed. Rather, the disclosure is to cover all modifications, equivalents, and alternatives falling within the spirit and scope of the disclosure as defined by the following appended claims. Further, although individual embodiments are discussed herein, the disclosure is intended to cover all combinations of these embodiments.

What is claimed is:

1. A method for conducting a subterranean operation, the method comprising:

storing, via a rig controller, pre-determined characteristics of a piece of equipment, which supports the subterranean operation performed on a rig, in a unique data record associated with the piece of equipment;

receiving at the rig controller the pre-determined characteristics of an expected piece of equipment to be used in the subterranean operation;

imaging, via one or more imaging sensors on a pipe handler, the piece of equipment in a horizontal storage area, wherein the pipe handler is horizontally moveable above the horizontal storage area in a first direction and a second direction, and wherein the first direction is opposite the second direction;

determining, via the rig controller and based on the imagery, actual characteristics of the piece of equipment in response to the imaging via the one or more imaging sensors;

comparing, via the rig controller, the actual characteristics to the pre-determined characteristics; and verifying whether or not the piece of equipment is the expected piece of equipment based on the comparing.

2. The method of claim 1, wherein the piece of equipment is one of a tubular, a tubular stand, a tool, a bottom hole assembly (BHA), or a drill floor piece of equipment.

3. The method of claim 1, wherein the unique data record comprises one of:

contact zones of the piece of equipment,
non-contact zones of the piece of equipment,
center of gravity of the piece of equipment,
diameters along the piece of equipment,
shapes of the piece of equipment,
weight of the piece of equipment,
dimensions of the piece of equipment,
type of the piece of equipment,
usage data of the piece of equipment,
degradation parameters of the piece of equipment,
manufacturing details of the piece of equipment,
longitudinal linearity of the piece of equipment,
historical data of the piece of equipment,
storage location,
orientation, or
combinations thereof.

4. The method of claim 3, wherein the degradation parameters of the piece of equipment comprise a location of wear, a severity indicator of wear, a type of wear, a location of damage, a severity indicator of damage, a type of damage, hours in service, or combinations thereof.

5. The method of claim 3, further comprising calculating an estimated center of gravity of the piece of equipment, the calculating comprising:

determining, via the rig controller, the dimensions of the piece of equipment of the piece of equipment including lengths and diameters;

determining a volume of material in the piece of equipment based on the dimensions;

determining a mass of the piece of equipment based on the volume of material and properties of the material; and calculating the estimated center of gravity of the piece of equipment based on the mass of the piece of equipment and the dimensions.

6. The method of claim 3, further comprising calculating an estimated center of gravity of the piece of equipment, the calculating comprising:

determining, via the rig controller, the dimensions of the piece of equipment including lengths and diameters;

manipulating the piece of equipment via rig equipment;

sensing torque and strain of the rig equipment, via sensors on the rig equipment, as the rig equipment manipulates the piece of equipment; and calculating an estimated center of gravity of the piece of equipment based on the torque and strain of the rig equipment and the dimensions.

7. The method of claim 3, wherein the usage data comprises time the piece of equipment is on or near the rig, where the piece of equipment is used in the subterranean operation, when the piece of equipment is used in the subterranean operation, how the piece of equipment is used in the subterranean operation, or combinations thereof.

8. The method of claim 3, wherein the historical data comprises one of the usage data, storage location data, life cycle data, expected end of life data, degradation data, unique identifiers, visible features detected, linearity data, calculated characteristics, torque measurements, revolutions required to thread or unthread a joint, or combinations thereof.

9. The method of claim 3, wherein the longitudinal linearity of the piece of equipment comprises measurements of deviation of the piece of equipment from being parallel to a desired central longitudinal axis.

10. The method of claim 1, wherein the one or more sensors comprise 2D camera, 3D camera, infrared camera, CCTV camera, X-ray sensor, strain gauge, torque sensor, accelerometer, optical sensor, laser sensor, physical contact sensor, contact sensor with encoder, audio sensor, pressure sensor, temperature sensor, environmental sensor, gas sensor, liquid sensor, or combinations thereof.

11. The method of claim 1, further comprising receiving the pre-determined characteristics of the piece of equipment from a manufacturer, an operator, a remote controller, lab tests, data books, or combinations thereof.

12. A method for conducting a subterranean operation, the method comprising:

storing, via a rig controller, pre-determined characteristics of a piece of equipment, which supports the subterranean operation performed on a rig, in a unique data record associated with the piece of equipment;

receiving at the rig controller the pre-determined characteristics of an expected piece of equipment to be used in the subterranean operation;

imaging, via one or more imaging sensors on a pipe handler, the piece of equipment in a horizontal storage area;

determining, via the rig controller and based on the imagery, actual characteristics of the piece of equipment in response to the imaging via the one or more imaging sensors;

comparing, via the rig controller, the actual characteristics to the pre-determined characteristics;

verifying whether or not the piece of equipment is the expected piece of equipment based on the comparing;

calculating an estimated center of gravity of the piece of equipment, comparing the estimated center of gravity to a center of gravity in the unique data record; and initiating corrective action on the rig when the estimated center of gravity is not substantially equal to the center of gravity in the unique data record.

13. A system for conducting a subterranean operation, the system comprising:

a rig configured to perform the subterranean operation;

a pipe handler that manipulates a piece of equipment on the rig during the subterranean operation, wherein the pipe handler is horizontally moveable over a horizontal storage area in a first direction and a second direction, and wherein the first direction is opposite the second direction; and one or more imaging sensors on the pipe handler configured to collect images of the piece of equipment in the horizontal storage area;

a rig controller configured to:

store pre-determined characteristics of the piece of equipment in a database in a unique data record associated with the piece of equipment;

receive, from the database, the pre-determined characteristics of an expected piece of equipment to be utilized in the subterranean operation;

receive the images from the one or more imaging sensors;

determine actual characteristics of the piece of equipment based on the images;

compare the actual characteristics to the pre-determined characteristics; and verify whether or not the piece of equipment is the expected piece of equipment based on the comparison.

14. The system of claim 13, wherein the unique data record comprises one of:

contact zones of the piece of equipment,
non-contact zones of the piece of equipment,
center of gravity of the piece of equipment,
diameters along the piece of equipment,
shapes of the piece of equipment,
weight of the piece of equipment,
dimensions of the piece of equipment,
type of the piece of equipment,
usage data of the piece of equipment,
degradation parameters of the piece of equipment,
manufacturing details of the piece of equipment,
longitudinal linearity of the piece of equipment,
historical data of the piece of equipment,
storage location,
orientation, or
combinations thereof.

15. The system of claim 14, wherein the type of the piece of equipment is selected from a group consisting of a tool, a tubular, a tubular stand, a BHA, and drill floor piece of equipment.

16. The system of claim 14, wherein the degradation parameters of the piece of equipment degradation parameters comprise a location of wear, a severity indicator of wear, a type of wear, a location of damage, a severity indicator of damage, a type of damage, hours in service, or combinations thereof.

17. The system of claim 14, wherein the non-contact zones are specific zones or areas on the piece of equipment that should not be contacted by rig equipment when the piece of equipment is manipulated by the rig equipment, and wherein the contact zones are specific zones or areas on the piece of equipment that can be contacted by rig equipment when the piece of equipment is manipulated by the rig equipment.

18. The system of claim 14, wherein the usage data comprises time the piece of equipment is in operation on the rig, where the piece of equipment is used in the subterranean operation, when the piece of equipment is used in the subterranean operation, how the piece of equipment is used in the subterranean operation, or combinations thereof.

19. The system of claim 14, wherein the historical data comprises the usage data, storage location data, life cycle data, expected end of life data, degradation data, unique identifiers, visible features detected, linearity data, calculated characteristics, torque measurements, torque requirements, revolutions required to thread or unthread a joint, or combinations thereof.

20. The system of claim 13, wherein the one or more sensors comprise 2D camera, 3D camera, infrared camera, CCTV camera, X-ray sensor, strain gauge, torque sensor, accelerometer, optical sensor, laser sensor, physical contact sensor, contact sensor with encoder, audio sensor, pressure sensor, temperature sensor, environmental sensor, gas sensor, liquid sensor, or combinations thereof.

* * * * *